US007268326B2

(12) United States Patent
Yamamoto et al.

(10) Patent No.: US 7,268,326 B2
(45) Date of Patent: Sep. 11, 2007

(54) MAGNETIC FLUX DRIVEN HEAT GENERATION MEMBER WITH MAGNETIC FLUX ADJUSTING MEANS

(75) Inventors: Naoyuki Yamamoto, Toride (JP); Takahiro Nakase, Toride (JP); Hitoshi Suzuki, Matsudo (JP); Yasuhiro Yoshimura, Ryugasaki (JP); Toshiharu Kondo, Moriya (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 11/254,835

(22) Filed: Oct. 21, 2005

(65) Prior Publication Data

US 2006/0086724 A1 Apr. 27, 2006

(30) Foreign Application Priority Data

Oct. 22, 2004 (JP) ..... 2004-307973

(51) Int. Cl.
*H05B 6/14* (2006.01)
*G03G 15/20* (2006.01)

(52) U.S. Cl. ..... 219/619; 219/670; 219/667; 399/328; 399/330

(58) Field of Classification Search ..... 219/619, 219/670, 652, 667, 668, 663, 665; 399/328–338
See application file for complete search history.

(56) References Cited

U.S. PATENT DOCUMENTS 5,534,987 A 7/1996 Ohtsuka et al. ..... 355/285
5,747,774 A 5/1998 Suzuki et al. ..... 219/216
5,822,669 A * 10/1998 Okabayashi et al. ..... 219/619
6,373,036 B2 4/2002 Suzuki ..... 219/619
6,782,216 B2 8/2004 Suzuki ..... 399/69
6,969,833 B2 11/2005 Suzuki ..... 219/619
6,970,664 B2 11/2005 Yamamoto ..... 399/69
7,034,261 B2 4/2006 Suzuki ..... 219/619
7,038,178 B2 5/2006 Suzuki ..... 219/619
7,122,769 B2 10/2006 Nami et al. ..... 219/619

(Continued)

FOREIGN PATENT DOCUMENTS

JP 59-33787 2/1984

(Continued)

*Primary Examiner*—Philip H. Leung
(74) *Attorney, Agent, or Firm*—Fitzpatrick, Cella, Harper & Scinto

(57) ABSTRACT

An electromagnetic induction heating apparatus capable of uniformize a temperature distribution in a longitudinal direction of an induction heating member includes: an exciting coil (magnetic flux generation means); a fixation roller (induction heating member) for generating heat by electromagnetic induction heating by action of magnetic flux generated by the exciting coil the induction heating member heating a material to be heated through heat generation thereof by introducing the material to be heated into a heating portion and conveying the material to be heated in contact with the fixation roller; and magnetic flux shielding plate (magnetic flux adjusting means) for changing a distribution of a density of an effective magnetic flux which is the magnetic flux generated by the exciting coil and actable on the fixation roller, in a longitudinal direction of the heating portion perpendicular to a conveyance direction of the material to be heated. The magnetic flux shielding plate adjusts the effective magnetic flux so that the effective magnetic flux at a central portion of the fixation roller in the longitudinal direction of the heating portion is less than that at an end portion of the induction heating member in the longitudinal direction.

9 Claims, 13 Drawing Sheets

U.S. PATENT DOCUMENTS

| | | | | |
|---|---|---|---|---|
| 7,132,631 | B2 | 11/2006 | Nami et al. | 219/619 |
| 2002/0186991 | A1* | 12/2002 | Watanabe et al. | 399/328 |
| 2003/0077093 | A1* | 4/2003 | Sekiguchi | 399/328 |
| 2005/0006378 | A1* | 1/2005 | Suzuki | 219/619 |
| 2005/0173415 | A1 | 8/2005 | Yamamoto et al. | 219/619 |
| 2005/0252912 | A1 | 11/2005 | Yamamoto | 219/619 |
| 2006/0086719 | A1 | 4/2006 | Suzuki et al. | 219/619 |
| 2006/0086724 | A1* | 4/2006 | Yamamoto et al. | 219/619 |
| 2006/0086726 | A1 | 4/2006 | Yamamoto et al. | 219/619 |
| 2006/0086730 | A1 | 4/2006 | Kondo et al. | 219/645 |
| 2006/0088327 | A1 | 4/2006 | Nakase et al. | 399/69 |
| 2006/0088328 | A1 | 4/2006 | Yoshimura et al. | 399/69 |
| 2006/0088329 | A1 | 4/2006 | Suzuki et al. | 399/69 |

FOREIGN PATENT DOCUMENTS

| | | |
|---|---|---|
| JP | 8-16006 | 1/1996 |
| JP | 2001-147606 | 5/2001 |

* cited by examiner (a) STANDBY STATE AND LARGE SIZE SHEET FIXATION (SHIELD POSITION)

(b) SMALL SIZE SHEET FIXATION (RETRACTED POSITION)

(a)STANDBY AND HEATING OF LARGE SIZE SHEET (SHIELD POSITION)

(b)HEATING OF SMALL SIZE SHEET(RETRACTED POSITION)

(a)STANDBY AND LARGE SIZE SHEET (CENTRAL PORTION SHIELD POSITION)

(b)MEDIUM SIZE SHEET (MEDIUM SIZE SHEET SHIELD POSITION)

(C)SMALL SIZE SHEET (SMALL SIZE SHEET SHIELD POSITION)

MAGNETIC FLUX DRIVEN HEAT GENERATION MEMBER WITH MAGNETIC FLUX ADJUSTING MEANS

FIELD OF THE INVENTION AND RELATED ART

The present invention relates to an electromagnetic induction heating-type heating apparatus, such as a heat fixation apparatus of an electromagnetic induction heating-type wherein an unfixed image formed on a recording material through an electrophotographic process is fixed under heating.

An image forming apparatus such as a copying machine, a printer, a facsimile machine, or the like, of an electrophotographic-type is equipped with a heating apparatus for heat-fixing a toner image, transferred onto a recording material such as a transfer material or the like, on the recording material. This heating apparatus includes a heating roller for melting toner on the recording material or a heating belt consisting of an endless belt and includes a pressure means which is pressed against the heating roller or the heating belt to sandwich the recording material with the heating roller and the heating belt.

The heating roller is internally or externally heated by a heat generation member directly or indirectly. As the heat generation member, e.g., a halogen heater, a heating resistor, or the like can be used. Particularly, in recent years, much importance has been attached to realization of energy saving of the image forming apparatus and improvement in usability (reduction in quick print time or warm-up time) at the same time. For this reason, as described in Japanese Laid-Open Patent Application (JP-A) No. Sho 59-033787, an induction heating apparatus employing induction heating with a high heat generation efficiency has been proposed.

The induction heating apparatus generates induction current (eddy current) with respect to a hollow heating roller formed of a metal conductor, so that the heating roller per se is caused to generate Joule heat by a skin resistance of the heating roller itself. By the induction heating apparatus, a heat generation efficiency is considerably improved, so that it becomes possible to reduce the warm-up time.

However, in such an induction heating apparatus, the heating roller is heated at a power in proportion to a skin resistance determined by a frequency of a high-frequency current to be applied, a permeability of the heating roller, and a resistivity of the heating roller. Accordingly, even when a thickness of the heating roller is large, a resultant heating generation rate is not changed. For this reason, in the case of the large thickness of the heating roller, a heat generation efficiency is rather decreased, so that it becomes difficult to achieve the effect of reducing the warm-up time.

On the other hand, when the heating roller thickness is excessively small, the magnetic flux passes through the heating roller. As a result, the heat generation efficiency is lowered and a peripheral metal member of the heating roller is heated. Accordingly, the heating roller may desirably have a thickness of approximately 20-300 μm.

However, in the case of using a thin heating roller in order to decrease a heat capacity, a cross-sectional area of a cross section perpendicular to an axis of the heat roller is very small, so that a heat transfer rate in the axial direction is not good. This tendency is more noticeably with a smaller cross-sectional area, and the heat transfer efficiency is further lowered when the heating roller is formed of a material, such as a resin having law thermal conductivity. This is also apparent from Fourier's law represented by the following equation:

$$Q=\lambda\times f(\theta 1-\theta 2)/L,$$

wherein Q represents an amount of heat, λ represents a thermal conductivity, (θ1−θ2) represents a difference in temperature between two points, and L represents a length.

As described above, in a longitudinal direction of the heating roller, the heat transfer rate is low and an amount of heat dissipation at both end portions of the heating roller is larger than that at a central portion. For this reason, in the case of fixing a recording material having a maximum recording width or in a standby state in which no fixation operation is performed, a temperature of the heating roller at the both end portions becomes low compared with that at the central portion (hereinafter referred to as an "end portion temperature lowering").

As a result, there arises such a problem that fixation failure is caused to occur at the both end portions of the heating roller in the longitudinal direction of the heating roller in the case where the recording material is continuously subjected to fixation or fixation of thick recording material is performed. Further, in the case where a fixing temperature is set to be high so as not to cause the fixation failure, there is also such a problem that energy consumption is increased and a fixed image is different in gloss between the central portion and the both end portions.

Further, in an ordinary induction heating apparatus, an exciting coil which generates magnetic flux is folded back at the both end portions in the longitudinal direction of the heating roller, so that a heat generation rate at both end portions of the heating roller opposite to the folded portion is smaller than that at another portion (a central portion). As a result, an end portion temperature lowering becomes noticeable.

As a countermeasure to the end portion temperature lowering, such as a proposal that positions of the exciting coil for generating magnetic flux and a magnetic core for introducing the generated magnetic flux to form a magnetic path are different from each other has been proposed.

However, in a constitution of such a proposal, it becomes possible to uniformize a temperature distribution in the longitudinal direction of the heating roller in the case of fixing the recording material with a maximum recording width or in the standby state but in the case of fixing a recording material with a width which is smaller than the maximum recording width, temperature is increased at the both end portions of the heating roller, i.e., in a non-sheet passing area of the recording material. As a result, there is a possibility that the heating roller, the exciting coil, and so on are broken at high temperatures.

Further, JP-A Hei 8-016006 has proposed such a constitution that a heating source is divided and selectively energized in a heating apparatus using an exciting coil as the heating source.

However, when a plurality of heating sources are used or a heating source is divided into plural portions, a control circuit becomes complicated by that much and production cost is also increased. Further, when a thin rotation member is used as the heating member, a temperature distribution in the neighbourhood of boundaries between the divided portions of the heating member is discontinuous and nonuniform, so that there is a possibility that a resultant fixation performance is adversely affected by the temperature distribution.

Further, JP-A 2001-147606 has proposed such a constitution that the end portion temperature lowering is prevented by bringing a heat-uniformizing member such as a heat pipe of metal or the like into contact with a rotation member which generates heat by electromagnetic induction heating.

However, in the constitution, by the contact of the heat-uniformizing member, a heat capacitance of the heating apparatus is increased, so that a warm-up time is prolonged to increase energy consumption.

SUMMARY OF THE INVENTION

The present invention has been accomplished in view of the above described problems.

An object of the present invention is to provide a heating apparatus capable of uniformizing a temperature distribution of an induction heating member in a longitudinal direction of the induction heating member to solve, e.g., problems of fixation failure, irregularity in gloss, and the like of an image in an image forming apparatus.

According to an aspect of the present invention, there is provided an electromagnetic induction heating apparatus, comprising:

magnetic flux generation means;

an induction heating member for generating heat by electromagnetic induction heating by action of magnetic flux generated by the magnetic flux generation means, the induction heating member heating a material to be heated through heat generation thereof by introducing the material to be heated into a heating portion and conveying the material to be heated in contact with the induction heating member or in contact with a heat transfer material disposed between the induction heating member and the material to be heated; and magnetic flux adjusting means for changing a distribution of a density of an effective magnetic flux which is the magnetic flux generated by the magnetic flux generation means and actable on the induction heating member, in a longitudinal direction of the heating portion perpendicular to a conveyance direction of the material to be heated;

wherein the magnetic flux adjusting means adjusts the effective magnetic flux so that the effective magnetic flux at a central portion of the induction heating member in the longitudinal direction of the heating portion is less than that at an end portion of the induction heating member in the longitudinal direction.

In a preferred embodiment, the apparatus further comprises drive means for driving the magnetic flux adjusting means, and the magnetic flux adjusting means is movable by the drive means to a shielding position at which the magnetic flux adjusting means changes a magnetic flux density distribution and a retracted position at which the magnetic flux adjusting means does not change the magnetic flux density distribution.

In the heating apparatus when the magnetic flux adjusting means is disposed at the retracted position, a higher heat generating rate of the induction heating member at the central portion in the longitudinal direction of the heating portion may preferably be larger than that at the end portion in the longitudinal direction.

The magnetic flux adjusting means may preferably comprise at least a nonmagnetic metal material or an alloy containing the nonmagnetic metal material.

The magnetic flux generation means may preferably comprise at least an exciting coil for generating magnetic flux and a magnetic core which is disposed in the neighbourhood of a winding center of the exciting coil and introduces magnetic flux generated by the exciting coil.

The magnetic flux adjusting means may preferably be interposed between the magnetic core and the induction heating member to change a density distribution of the effective magnetic flux.

The induction heating member may preferably be a hollow rotation member.

The magnetic flux generation means and the magnetic flux adjusting means may be disposed inside and in the neighbourhood of the induction heating member or disposed outside and in the neighbourhood of the induction heating member.

In the heating apparatus, a rotatable rotation member may preferably be disposed at a periphery of the induction heating member.

The heating apparatus may preferably be constituted as a heat fixation apparatus for heat-fixing an image on a recording material as a permanent image.

According to the present invention, by the action of the magnetic flux adjusting means, a heat generating rate at a central portion of the induction heating member in its longitudinal direction is smaller than that at both end portions by decreasing effective magnetic flux at the longitudinal central portion of the induction heating member compared with that at the both end portions, so that a temperature distribution in the longitudinal direction of the induction heating member is uniform. For this reason, e.g., in an image forming apparatus, it is possible to solve problems of image fixation failure, image gloss irregularity, etc. Further, heat generation itself of the induction heating member is reduced by the magnetic flux adjusting means, so that a heat capacitance of the heating apparatus is not increased and it is possible to realize energy saving.

These and other objects, features and advantages of the present invention will become more apparent upon a consideration of the following description of the preferred embodiments of the present invention taken in conjunction with the accompanying drawings.

DETAILED DESCRIPTION OF THE PREFERRED EMBODIMENTS

Hereinbelow, embodiments of the present invention will be described with reference to the drawings.

Embodiment 1

Figure 1:
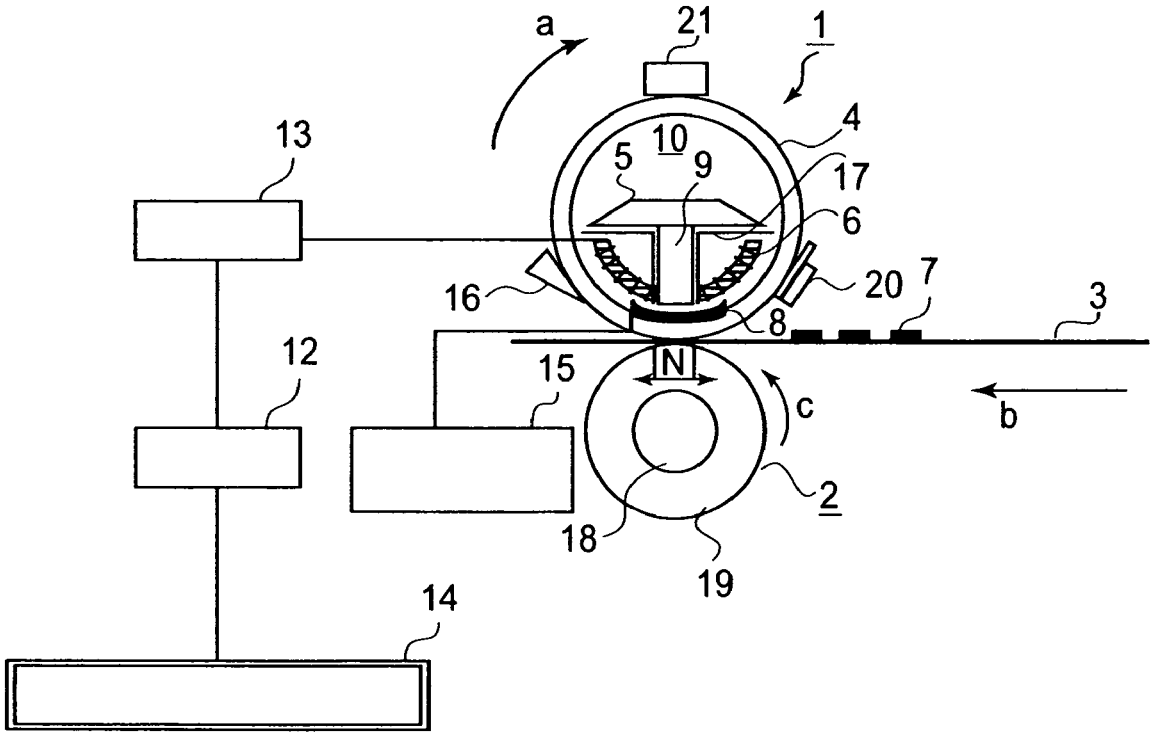
FIG. 1 is a schematic sectional view of a heat fixation apparatus according to Embodiment 1 of the present invention.

FIG. 1 is a cross-sectional view showing a schematic constitution of a heat fixation apparatus of an induction heating-type according to Embodiment 1 of the present invention.

Referring to FIG. 1, a heat fixation apparatus 1 of an induction heating-type metals an unfixed toner image 7 formed on a conveyed recording material 3 as a material to be heated by heat and pressure to fix the melted toner image on the recording material 3. The heat fixation apparatus 1 includes a coil assembly 10 as a magnetic flux generation means for generating a high-frequency magnetic field, a fixation roller 4 as an induction heating member which is heated by the coil assembly 10 and movably disposed along a conveyance direction of the recording material 3, a stay 5 fixed to an unshown frame in order to keep a uniform gap between the fixation roller 4 and the coil assembly 10, and a pressure roller 2 which is disposed opposite to and pressed against the fixation roller 4 through a conveyance passage of the recording material 3.

The fixation roller 4 is rotatably disposed in a direction of an indicated arrow a and is rotationally driven by an unshown drive source such as a motor or the like. The pressure roller 2 is rotated by the rotation of the fixation roller 4 in a direction of an indicated arrow c.

A CPU 12 is a timing control means for effecting control of the heat fixation apparatus 1, and a drive power source 13 supplies a high-frequency current to the coil assembly 10 based on a signal from the CPU 12. A recording material size detection means 14 detects a size of the recording material and, e.g., judges the recording material size on the basis of a combination of plural signals input through push switches of a user panel.

A magnetic flux shielding plate drive means 15 is a drive means for effecting displacement control of a magnetic flux shielding plate 8 as a magnetic flux shielding means by a signal from the CPU 12. The recording material 3 onto which an unfixed toner image 7 is transferred is fed in a direction of an indicated arrow b and introduced into a pressing nip portion N for sandwiching the recording material 3 between the fixation roller 4 and the pressure roller 2.

The recording material 3 is conveyed in the pressing nip portion N while receiving heat from the heated fixation roller 4 and pressure from the pressure roller 2, whereby the unfixed toner is fixed on the recording material 3 to form a fixed toner image. The recording material 3 having passed through the nip portion N is separated from the fixation roller 4 by a separation claw 16 having an end portion which abuts against the surface of the fixation roller 4 to be conveyed in a left-hand direction in FIG. 1, thus being conveyed by an unshown discharge (output) roller to be discharged (outputted) on a discharge (output) tray.

Here, the fixation roller 4 is formed of a hollow metal conductor and has an electroconductive (metal) layer of, e.g., iron, nickel, SUS 430, or the like. At an outermost surface of the fixation roller 4, a release layer which has a high heat resistance and is formed of a fluorine-containing resin or the like is disposed. Incidentally, in this embodiment, the metal layer of the fixation roller 4 has a thickness of 20 μm to 3.0 mm.

At a hollow portion of the fixation roller 4, the coil assembly 10 for generating the high-frequency magnetic field is disposed, and by the action of the high-frequency magnetic field, eddy current is induced in the fixation roller 4 to cause the fixation roller 4 to generate Joule heat. Here, the coil assembly 10 is held by an unshown stay between the fixation roller 4 and the exciting coil 6 with a certain gap. The stay is fixed to an unshown frame and is not rotated.

The coil assembly 10 includes a magnetic core 9, a bobbin 17 provided with a hole into which the magnetic core 9 is inserted, and the exciting coil 6 which is constituted by copper wire wound around the bobbin 17 and heats the fixation roller 4 by inducing eddy current in the fixation roller 4.

As a material for the magnetic core 9, it is desirable to have a large permeability and a small self(-field) loss. For example, ferrite, permalloy, sendust, amorphous, silicon steel plate, and the like may suitably be used. The bobbin 17 functions as an insulating portion which electrically isolate the magnetic core 9 from the exciting coil 6. Further, the coil assembly 10 is fixed to the stay which is integrally or separately constituted with the bobbin 17 and is accommodated so as not to be exposed outside the fixation roller 4.

The stay, the separation claw 16, and the bobbin 17 are constituted by heat-resistant and electrically insulating engineering plastics. The pressure roller 2 is constituted by an axial core 18, a heat-resistant rubber layer 19 formed around the axial core 18, and a heat-resistant release layer formed of a fluorine-containing resin or the like as an outermost layer.

Further, on an outer peripheral surface of the fixation roller 4, a temperature sensor 20 for detecting a temperature of the fixation roller 4 is disposed. The temperature sensor 20 is disposed in contact with or close to the outer surface of the fixation roller 4 so as to be opposite to the exciting coil 6 through the fixation roller 4 or disposed in contact with or close to the inner surface of the fixation roller 4 so as to be opposite to the exciting coil 6. Further, the temperature sensor 20 is constituted by, e.g., a thermistor which detects a temperature of the fixation roller 4. On the basis of this detection signal, energization of the exciting coil 6 is controlled so that the temperature of the fixation roller 4 is an optimum temperature.

Above the fixation roller 4, a thermostat as a safety mechanism during abnormal temperature rise is disposed. The thermostat is disposed in contact with or close to the fixation roller 4 and opens a contact when the temperature of the fixation roller 4 reaches a preliminarily set temperature to deenergize the exciting coil 6, thus preventing the fixation roller 4 from being heated to a high temperature not less than a predetermined temperature.

Figure 2:
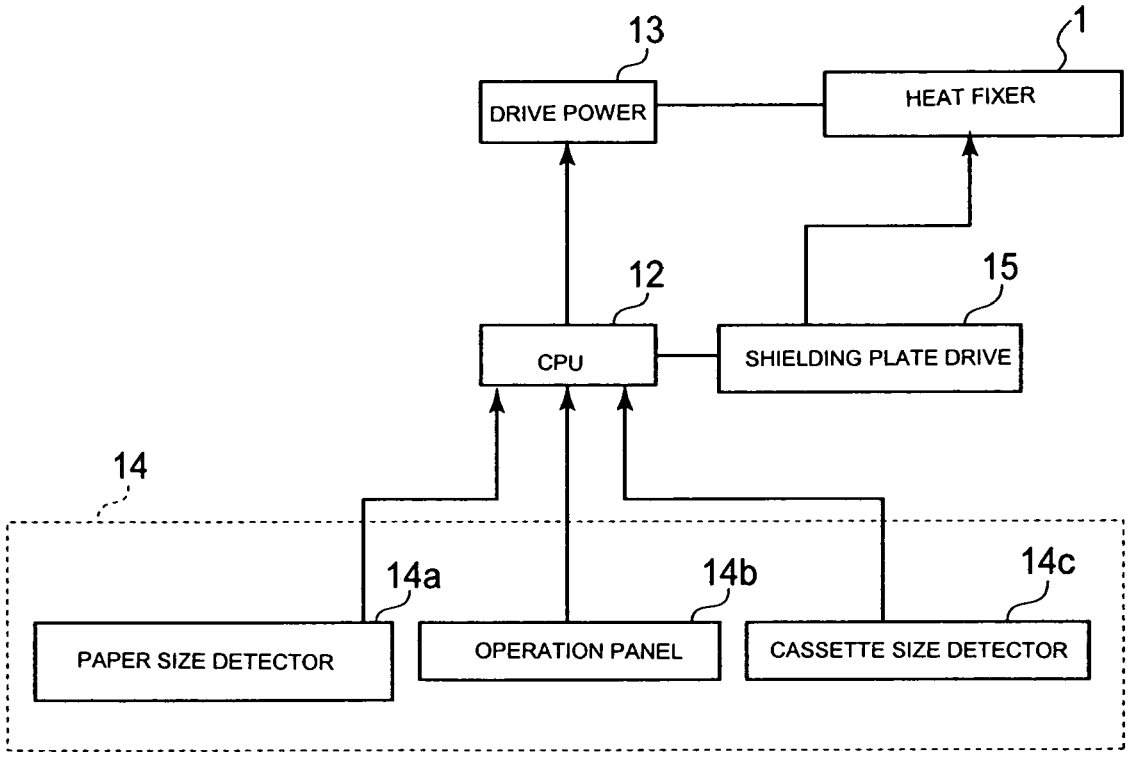
FIG. 2 is a block diagram showing a schematic constitution of a recording material size detection means in the present invention.

FIG. 2 is a block diagram showing a constitution of the recording material size detection means 14. The recording material size detection means 14 is constituted by a size detection means 14*a* during recording material conveyance, an operation panel 14*b*, and a cassette size detection means 14*c*. The cassette size detection means 14*c* and the size detection means 14*a* during recording material conveyance are constituted by an ultrasonic sensor or the like. Incidentally, a constitution is based on a signal for a size of a recording material which is preliminarily set and selected at a user operation panel but may be used in combination with such a constitution that the recording material size is detected by sensors disposed in a sheet feeding cassette and a conveyance path during the recording material conveyance in order to obviate an operating error and insertion of a recording material with a different size into the sheet feeding cassette by the user.

In this embodiment, between the fixation roller 4 and the exciting coil 6, a magnetic flux shielding plate 8 as a magnetic flux adjusting means for shielding a part of magnetic flux which reaches from the exciting coil 6 to the fixation roller 4 is movably disposed. By changing a position of the magnetic flux shielding plate 8 in a circumferential direction by using a magnetic flux shielding plate drive means 15, the magnetic flux shielding plate 8 is constituted so as to control a heat generation range due to eddy current in cooperation with the recording material size detection means 14.

The magnetic flux shielding plate drive means 15 has an unshown motor for rotationally driving the magnetic flux shielding plate 8. It is possible to rotate the magnetic flux shielding plate 8 in the circumferential direction of the fixation roller 4 by the drive of the motor. As the motor, it is possible to use, e.g., a stepping motor or the like. Incidentally, the magnetic flux shielding plate drive means 15 is not limited to the above described constitution but may has a belt in place of the motor or may be constituted so that it is rotationally driven by a screw.

As the magnetic flux shielding plate 8, an electroconductive nonmagnetic material, having a small resistivity, such as copper, aluminum, silver, their alloys, etc., may suitably be used.

Figure 3:
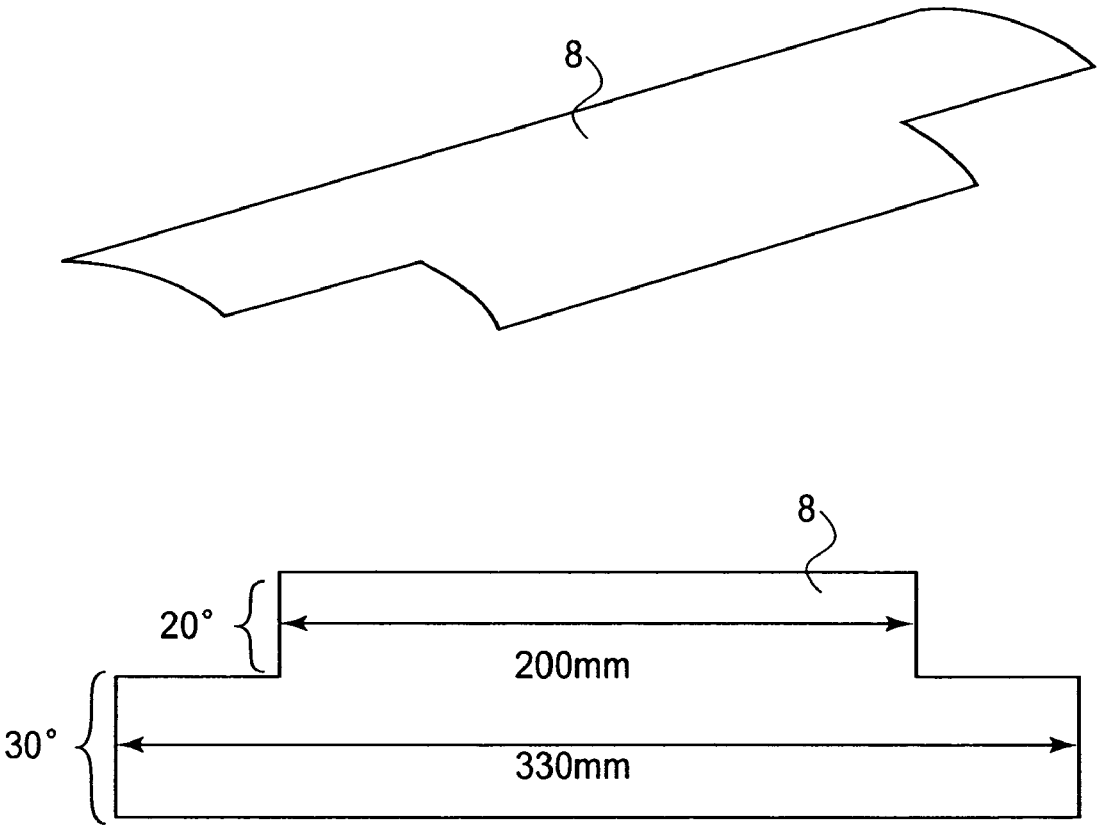
FIG. 3 is a constitutional view of a magnetic flux shielding plate used in Embodiment 1.

FIG. 3 shows an example of a shape of the magnetic flux shielding plate 8 used in this embodiment. The magnetic flux shielding plate 8 used in this embodiment is constituted by copper having a purity of not less than 99% and has a projection portion with a width of 200 mm, and is set to form an angle of 20 degrees in the circumferential direction of the fixation roller 4.

Figure 4:
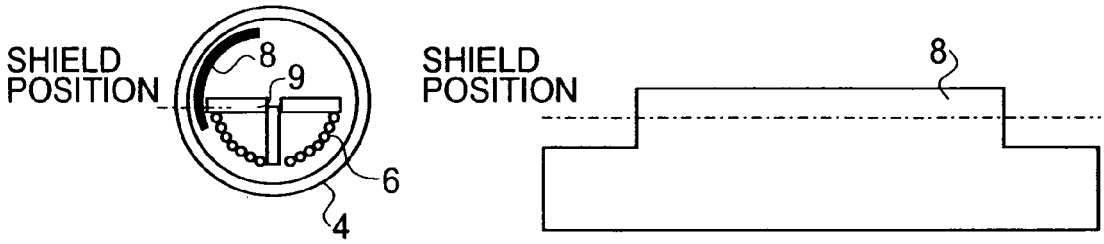
FIGS. 4(*a*) and 4(*b*) are operation explanation views of the magnetic flux shielding plate used in Embodiment 1.
Figure 4:
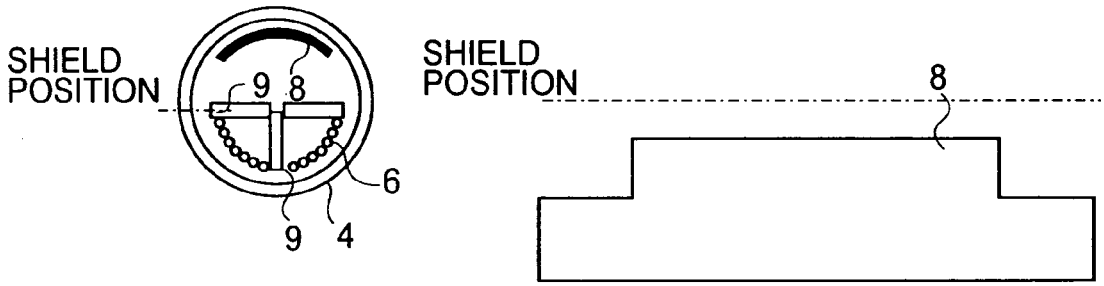

FIGS. 4(*a*) and 4(*b*) show operation positions of the magnetic flux shielding plate 8 in this embodiment.

In the heat fixation apparatus 1, the projection portion of the magnetic flux shielding plate 8 is interposed between the magnetic core 9 and the fixation roller 4 with a predetermined gap as shown in FIG. 4(*a*) when the recording material 3 is placed in a heatable state (standby state) or when a large-sized recording material, such as A4Y (long side), A3, and the like is heated. Further, in the case of a small-sized recording material, as shown in FIG. 4(*b*), the magnetic flux shielding plate 8 is retracted to a retracted position at which magnetic flux generated from the exciting coil 6 is not substantially prevented.

Figure 5:
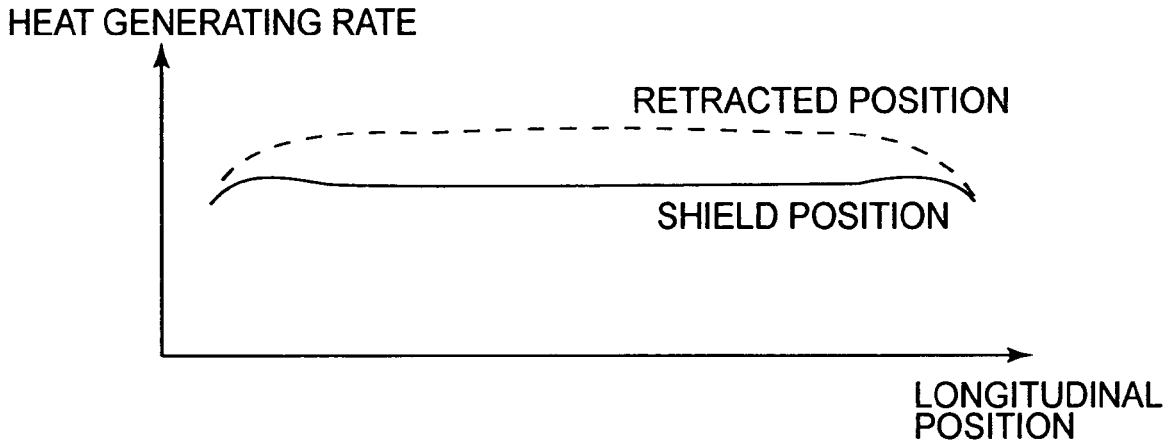
FIG. 5 is a graph showing a distribution of heat generating rate of the heat fixation apparatus according to Embodiment 1.

FIG. 5 shows a distribution of a heat generation rate of the fixation roller 4 in the longitudinal direction of the fixation roller 4 in this embodiment.

The fixation roller 4 used in this embodiment has a small thickness of 20 μm to 3 mm, so that a degree of thermal transfer in the longitudinal direction of the fixation roller 4 is small. Further, at both end portions of the fixation roller 4, a heat dissipation rate is larger than that at a central portion and the exciting coil 6 is folded back at the both end portions of the fixation roller 4, so that the heat generation rate at the both end portions is smaller than that at the central portion. As a result, a degree of the end portion temperature lowering becomes noticeable.

However, in this embodiment, the magnetic flux shielding plate 8 is interposed at the longitudinal central portion of the fixation roller 4 to decrease the heat generation rate at the central portion, so that the heat generation rate at the both end portions are relatively increased. As a result, it is possible to substantially uniformize a distribution of the heat generation rate in the longitudinal direction of the fixation roller 4.

Next, an operation sequence of the magnetic flux shielding plate 8 in this embodiment will be described with reference to FIG. 6.

Figure 6:
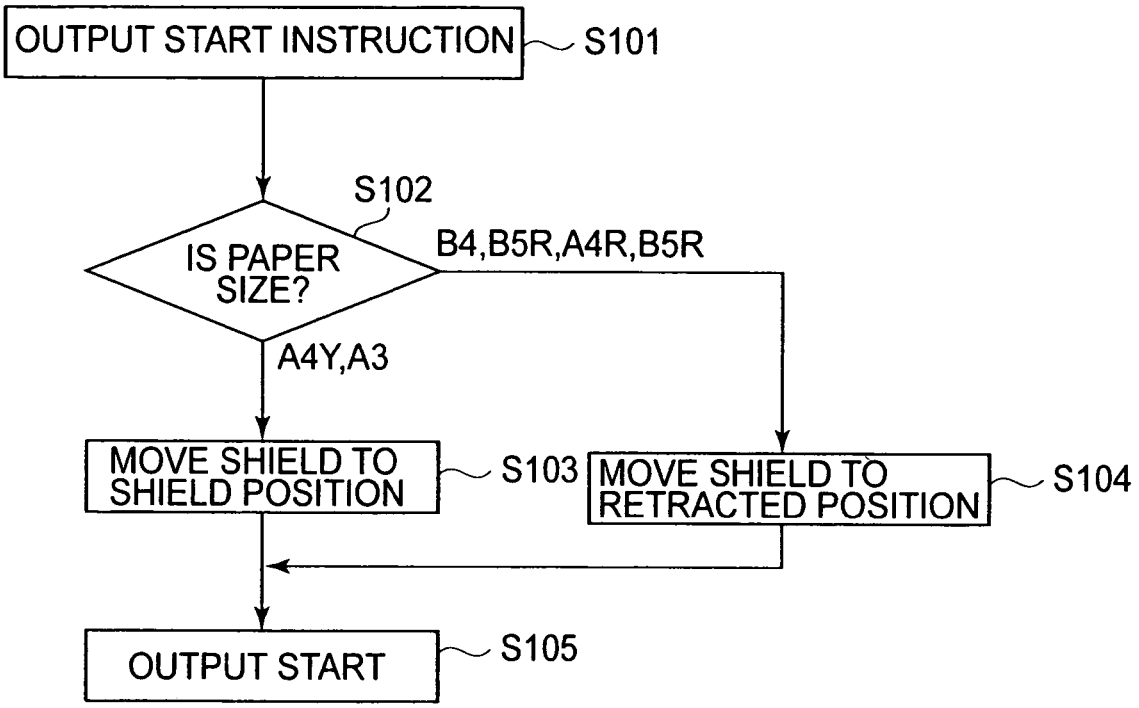
FIG. 6 is an operation sequence diagram of the magnetic flux shielding plate used in Embodiment 1.

Referring to FIG. 6, when a CPU 12 outputs an instruction to start a heating operation of the recording material 3 to the heat fixation apparatus 1 (S101), the recording material size detection means 14 detects a size of the recording material 3 (S102) and the magnetic flux shielding plate 8 is disposed at the shielding position in the case where the recording material 3 has a size of A4Y (long side) or A3 (S103). On the other hand, in the case where the recording material 3 has a size (B4, B5Y (long side), A4R (short side), B5R (short side), etc.) other than A4Y and A3, the magnetic flux shielding plate 8 is disposed at the retracted position (S104). Thereafter, sheet passing of the recording material 3 under heating is started (S105).

Figure 7:
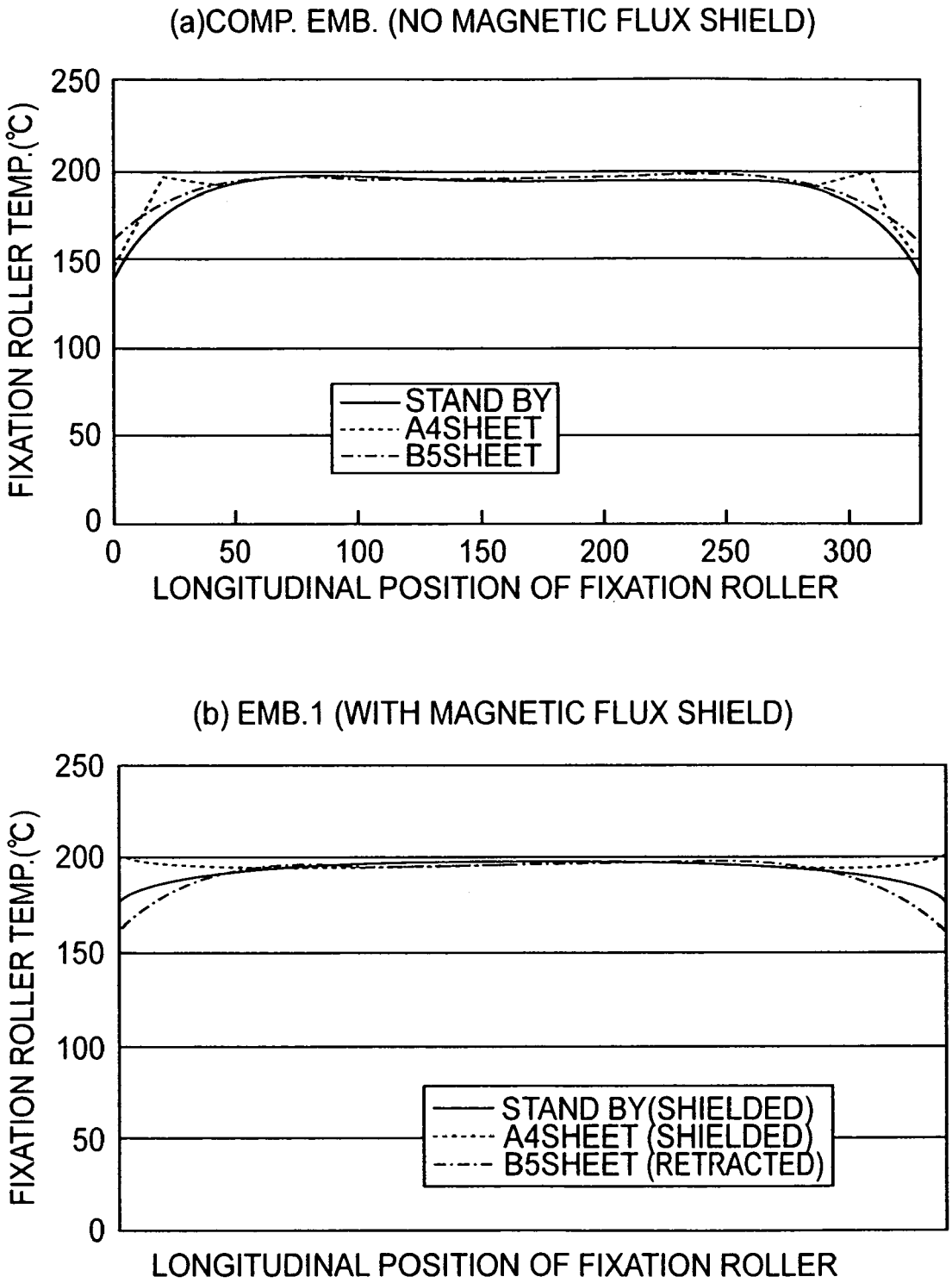
FIGS. 7(*a*) and 7(*b*) are graphs showing temperature distributions of heat fixation apparatus according to Comparative Embodiment and Embodiment 1.

In this embodiment, a temperature distribution of the fixation roller 4 in the longitudinal direction of the fixation roller 4 when the position of the magnetic flux shielding plate 8 is changed is shown in FIG. 7(*b*). On the other hand, FIG. 7(*a*) shows a temperature distribution of the fixation roller 4 in the fixation roller longitudinal direction when the magnetic flux shielding plate 8 is not disposed, as a comparative embodiment for this embodiment.

As shown in FIG. 7(*b*), in this embodiment, it is possible to substantially uniformize the temperature distribution of the fixation roller in the fixation roller longitudinal direction in all the cases of the times of standby, A4-sheet heating, and B5Y-sheet heating. On the other hand, in the comparative embodiment, as shown in FIG. 7(*a*), the end portion temperature lowering is caused to occur.

Incidentally, the constitution of this embodiment is not described so as to limit the scope of the present invention but may be variously modified depending on a heat fixation apparatus to which the present invention is applied. For example, in this embodiment, the fixation roller 4 is used as the induction heating member but the present invention is also applicable to even an endless belt of metal such as nickel or the like. Further, in this embodiment, the magnetic flux shielding plate 8 has a one-stage projection portion but may also have a projection portion having two or more stages so as to meet further sizes of the recording material.

In this embodiment, as shown in FIGS. 4(*a*) and 4(*b*), the magnetic flux shielding plate 8 is interposed at a horizontal portion of the magnetic core 9 disposed in a substantially T-shape but may also be interposed at a vertical portion of the T-shaped magnetic core 9 as shown in FIG. 1. Further, the shape of the magnetic core 9 in the present invention is not limited only to the T-shape.

Further, the magnetic flux shielding plate 8 used in this embodiment is substantially symmetrical with respect to the longitudinal direction of the fixation roller 4 but may also be asymmetrical in the case where a recording material having a different size is passed through the heat fixation apparatus with one end of the fixation roller 4 as a reference position.

Embodiment 2

Embodiment 2 of the present invention will be described.

Figure 8:
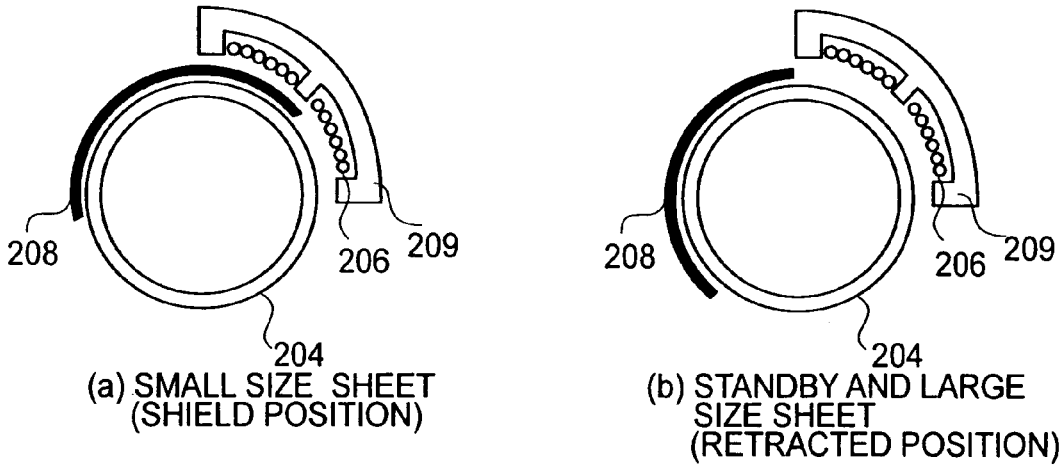
FIGS. 8(*a*) and 8(*b*) are operation explanation views of a magnetic flux shielding plate used in Embodiment 2 of the present invention.

FIGS. 8(*a*) and 8(*b*) are sectional views of a heat fixation apparatus according to this embodiment, wherein FIG. 8(*a*) shows a shielding position of a magnetic flux shielding plate during passing of a small-sized sheet and FIG. 8(*b*) shows a retracted position of the magnetic flux shielding plate during standby end passing of a large-sized sheet.

In the heat fixation apparatus of this embodiment, in the neighbourhood of an outer peripheral surface of a fixation roller 204, an exciting coil 206 and a magnetic core 209 are disposed. A magnetic flux shielding plate 208 is disposed between the fixation roller 204 and the exciting coil 206 (and the magnetic core 209) with a certain gap.

In this embodiment, outside the fixation roller 204, the magnetic flux shielding plate 208 and the exciting coil 206 are disposed, so that heat release from the fixation roller 204 to ambient air can be expected. Accordingly, the temperature of the exciting coil 206 is lower than that in the case of Embodiment 1, so that it is possible to expect that high-efficiency heating is performed.

Figure 9:
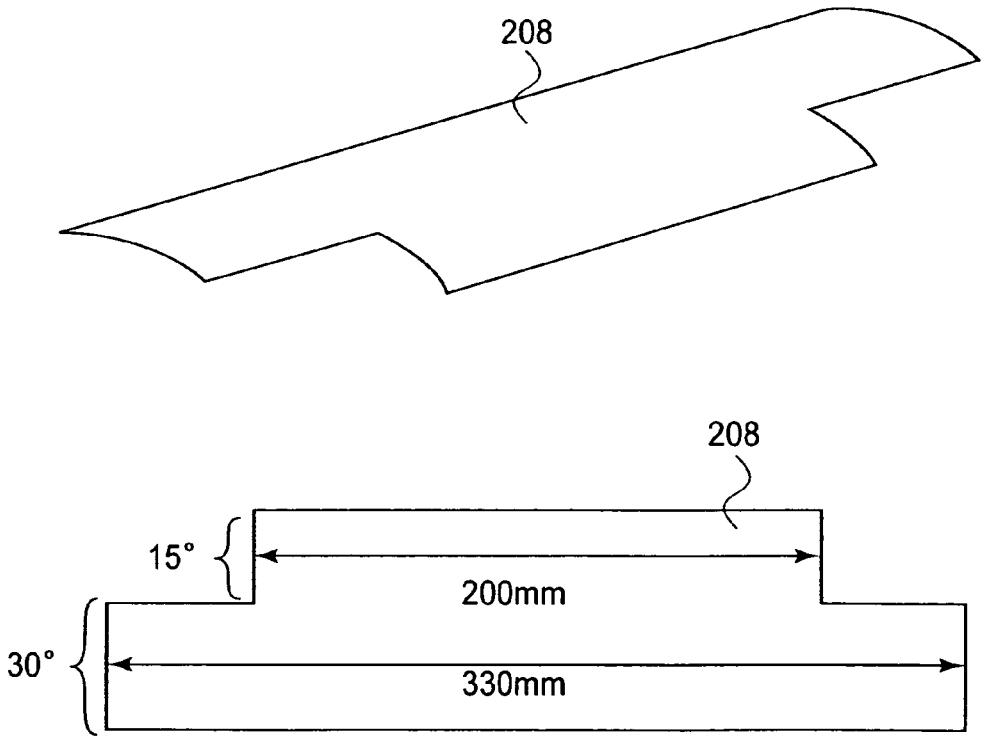
FIG. 9 is a constitutional view of the magnetic flux shielding plate used in Embodiment 2.

The magnetic flux shielding plate 208 used in this embodiment has a shape as shown in FIG. 9. In this embodiment, an angle of the projection portion of the magnetic flux shielding plate 208 is 15 degrees.

Also in this embodiment, the magnetic flux shielding plate 208 adjusts the magnetic flux induced in a central portion of the fixation roller 204 in a longitudinal direction of the fixation roller 204, so that it is possible to uniformize a temperature distribution in the longitudinal direction of the fixation roller 204.

Incidentally, the constitution of this embodiment is not described so as to limit the scope of the present invention but may be variously modified similarly as in Embodiment 1.

Embodiment 3

Embodiment 3 of the present invention will be described.

Figure 10:
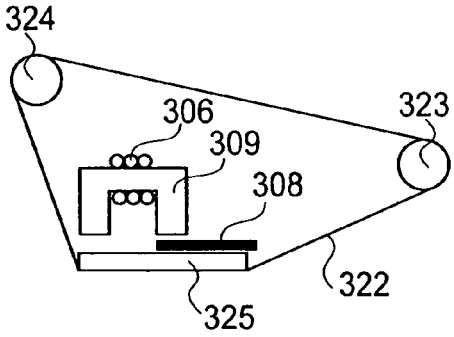
FIGS. 10(*a*) and 10(*b*) are operation explanation views of a magnetic flux shielding plate used in Embodiment 3 of the present invention.
Figure 10:
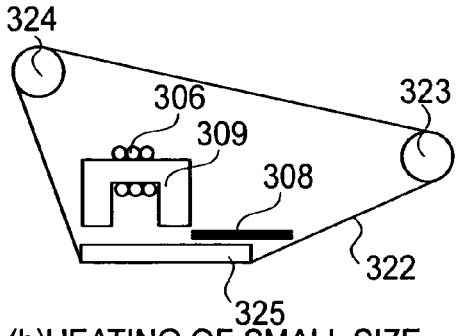

FIGS. 10(*a*) and 10(*b*) are sectional views of a heat fixation apparatus according to this embodiment, wherein FIG. 10(*a*) shows a shielding position of a magnetic flux shielding plate during standby and heating of a large-sized sheet and FIG. 10(*b*) shows a retracted position of the magnetic flux shielding plate during heating of a small-sized sheet.

In the heat fixation apparatus of this embodiment, an exciting coil 306 as a magnetic flux generation means is wound around a magnetic core 309 and heats a heating plate 325 as a induction heating member by induction heating. An endless belt 322, as a rotation member, which is extended around tension rollers 323 and 324 and is heated in contact with the heating plate 325 is rotationally driven by an unshown drive means. A magnetic flux shielding plate 308 is interposed between the magnetic core 309 and the heating plate 325 with a certain gap.

In this embodiment, the heating plate 325 as the induction heating member and the endless belt as the rotation member are separately prepared, so that it is possible to use an endless belt of a heat-resistant resin as the endless belt 322.

Figure 11:
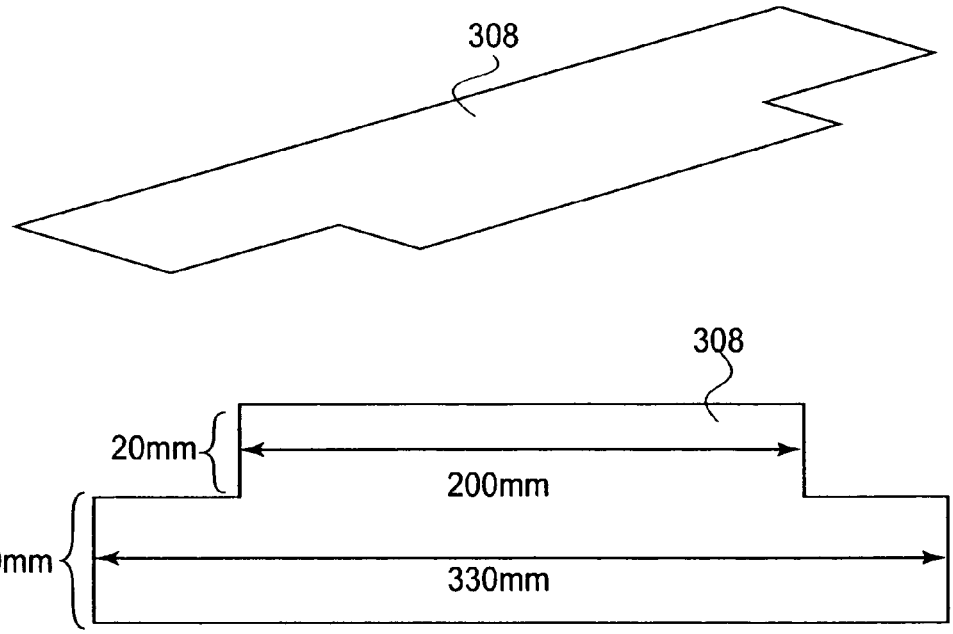
FIG. 11 is a schematic view of the magnetic flux shielding plate used in Embodiment 3.

The magnetic flux shielding plate 308 used in this embodiment has a shape as shown in FIG. 11. In this embodiment, the magnetic flux shielding plate 308 has a substantially planar shape and is provided with a projection portion having a height of 20 mm.

Also in this embodiment, the magnetic flux shielding plate 308 adjusts the magnetic flux induced in a central portion of the fixation roller 304 in a longitudinal direction of the fixation roller 304, so that it is possible to uniformize a temperature distribution in the longitudinal direction of the fixation roller 304.

Incidentally, in this embodiment, the magnetic flux shielding plate 308 has the substantially planar shape but may also be replaced with a curve-shaped magnetic flux shielding plate depending on a structure of the heat fixation apparatus. Further, the constitution of this embodiment is not described so as to limit the scope of the present invention but may be variously modified similarly as in Embodiment 1.

Embodiment 4

Embodiment 4 of the present invention will be described.

In the above described constitutions of

Embodiments 1 to 3, in a continuous fixation operation in which various kinds and sizes of sheets (papers) are used in mixture, the magnetic flux shielding plate is operated depending on the recording material sizes. As a result, the number of operation of the magnetic flux shielding plate is increased.

For this reason, in the heat fixation apparatus according to this embodiment, even when the continuous fixation operation for the various kinds and sizes of recording materials is performed, the number of operation of the magnetic flux shielding plate is decreased as small as possible and a temperature distribution of the fixation roller in a longitudinal direction of the fixation roller is uniformized.

Figure 12:
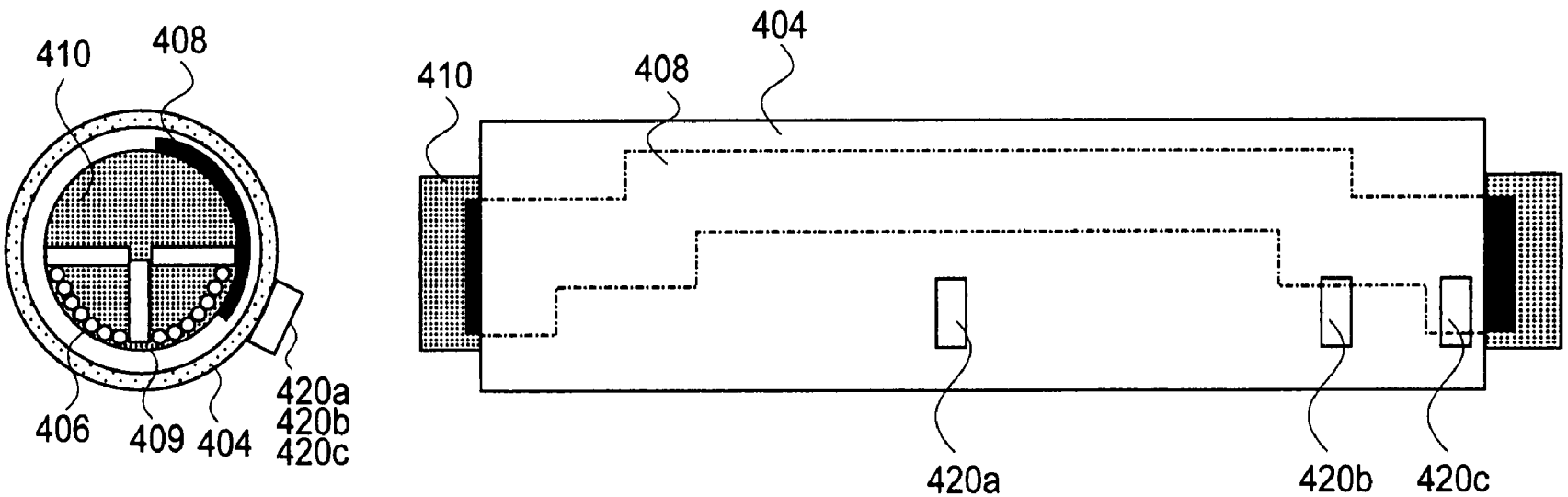
FIG. 12 is a schematic constitutional view of a heat fixation apparatus according to Embodiment 4 of the present invention.

FIG. 12 is a schematic constitutional view of the heat fixation apparatus of this embodiment.

In this embodiment, inside a fixation roller 404, a coil assembly 410 containing therein an exciting coil 406 and a magnetic core 409 is held with a predetermined gap between the coil assembly 410 and an inner surface of the fixation roller 404. Further, a magnetic flux shielding plate 408 is movable to an arbitrary position along the surface of the coil assembly 410 by an unshown magnetic flux shielding plate drive apparatus. A main thermistor 420*a*, a thermistor 420*b* for small-sized sheet, and a thermistor 420*c* for medium-sized sheet which are used for detecting a temperature of the fixation roller 404, are disposed at the surface of the fixation roller 404.

Figure 13:
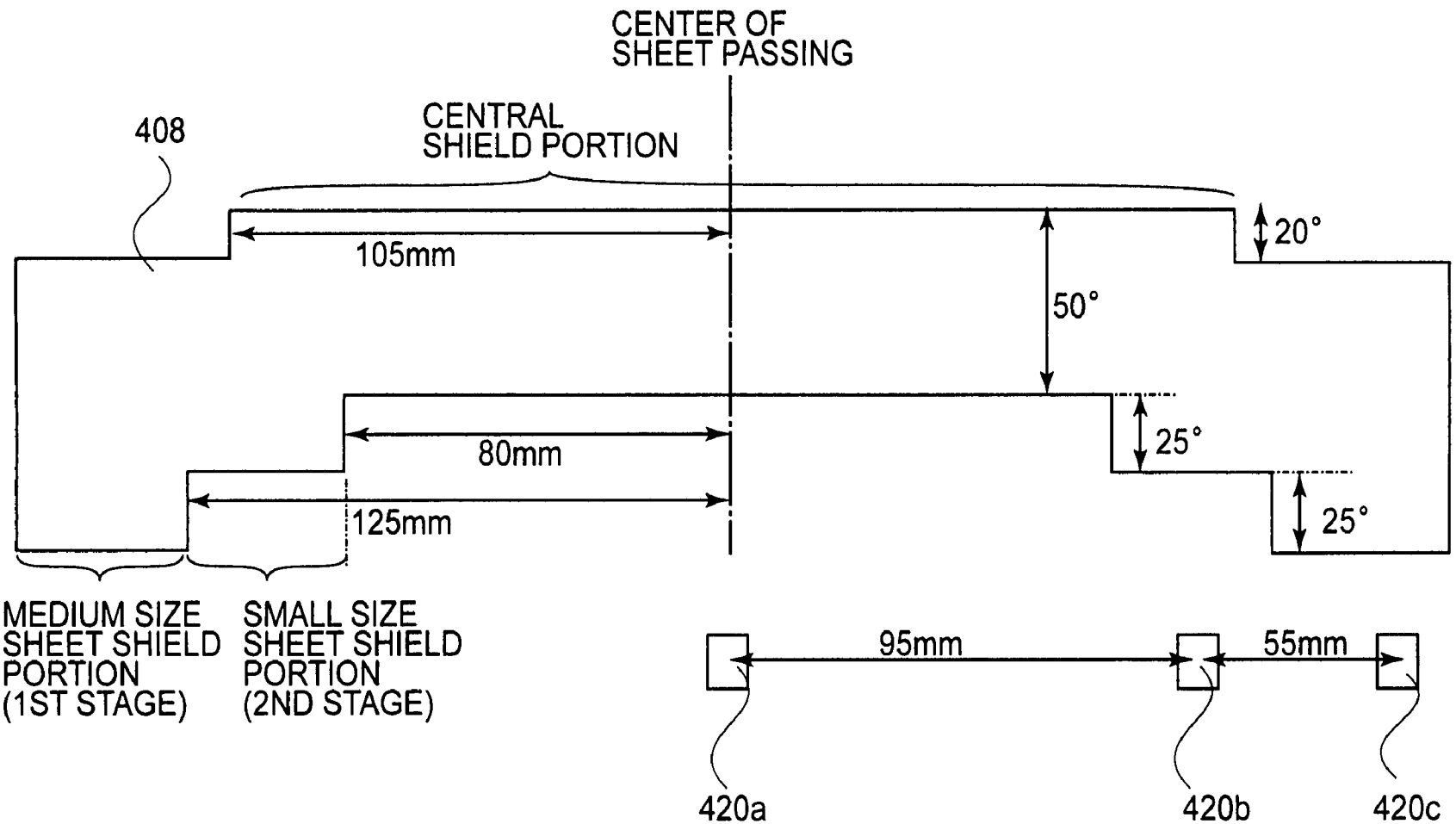
FIG. 13 is a schematic view of a magnetic flux shielding plate used in Embodiment 4.

The magnetic flux shielding plate 408 is symmetrical with respect to an almost center (of sheet passing) as shown in FIG. 13 and is provided with a central shielding portion, a medium-sized sheet shielding portion, and a small-sized sheet shielding portion. Further, the main thermistor 420*a*, the thermistor 420*b* for the small-sized sheet, and the thermistor 420*c* for the medium-sized sheet are disposed at the central shielding portion, the small-sized sheet shielding portion, and the medium-sized sheet shielding portion, respectively.

Figure 14:
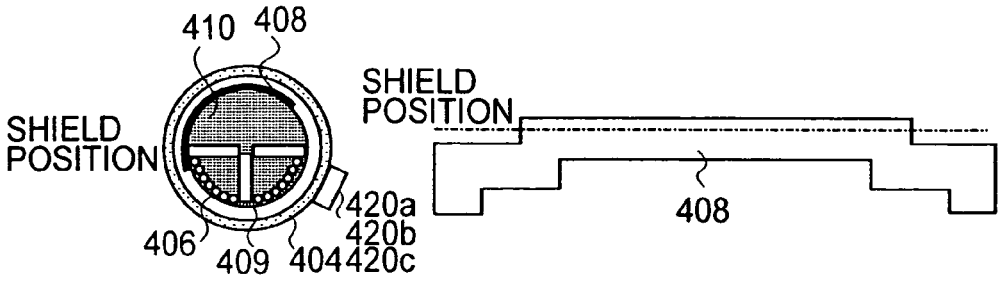
FIGS. 14(*a*) to 14(*c*) are operation explanation views of the magnetic flux shielding plate used in Embodiment 4.
Figure 14:
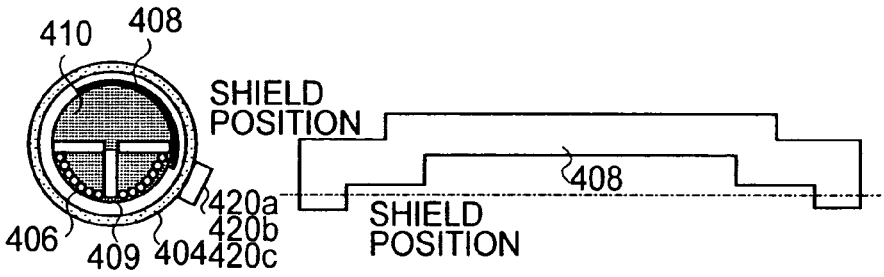
Figure 14:
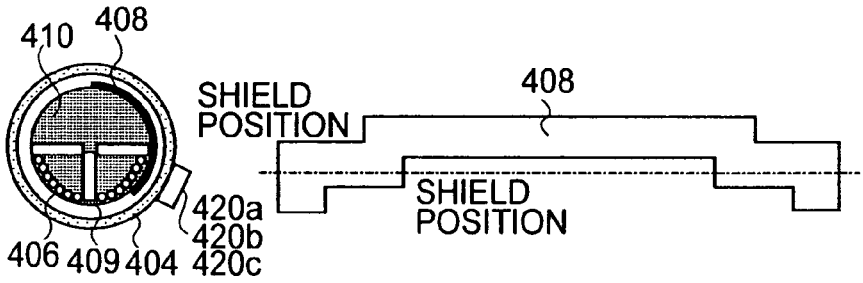

Next, operational positions of the magnetic flux shielding plate 408 in this embodiment are shown in FIGS. 14(*a*), 14(*b*) and 14(*c*)>

In the heat fixation apparatus according to this embodiment, in a heatable state of the recording material (standby state) and during heating of a large-sized sheet such as A4Y, A3, etc., as shown in FIG. 14(*a*), the central shielding portion of the magnetic flux shielding plate 408 is interposed between the magnetic core 409 and the fixation roller 404 with a predetermined gap to reduce the heat generation rate at the central portion of the fixation roller 404 in a fixation roller longitudinal direction. As a result, a temperature distribution of the fixation roller 404 in the fixation roller longitudinal direction is uniformized.

Further, with respect to the medium-sized recording material such as B4, B5Y and the like, as shown in FIG. 14(*b*), the medium-sized sheet shielding portion of the magnetic flux shielding plate 408 is interposed between the magnetic core 409 and the fixation roller 404 with a predetermined gap to reduce the heat generation rate in a non-sheet passing portion (area) of the medium-sized recording material. As a result, a temperature rise at the non-sheet passing portion of the fixation roller 404 is alleviated.

Further, with respect to the small-sized recording material such as A4R, B5R, A5R and the like, as shown in FIG. 14(*b*), the medium-sized sheet shielding portion of the magnetic flux shielding plate 408 is interposed between the magnetic core 409 and the fixation roller 404 with a predetermined gap to reduce the heat generation rate in a non-sheet passing portion (area) of the small-sized recording material. As a result, a temperature rise at the non-sheet passing portion of the fixation roller 404 is alleviated.

Figure 15:
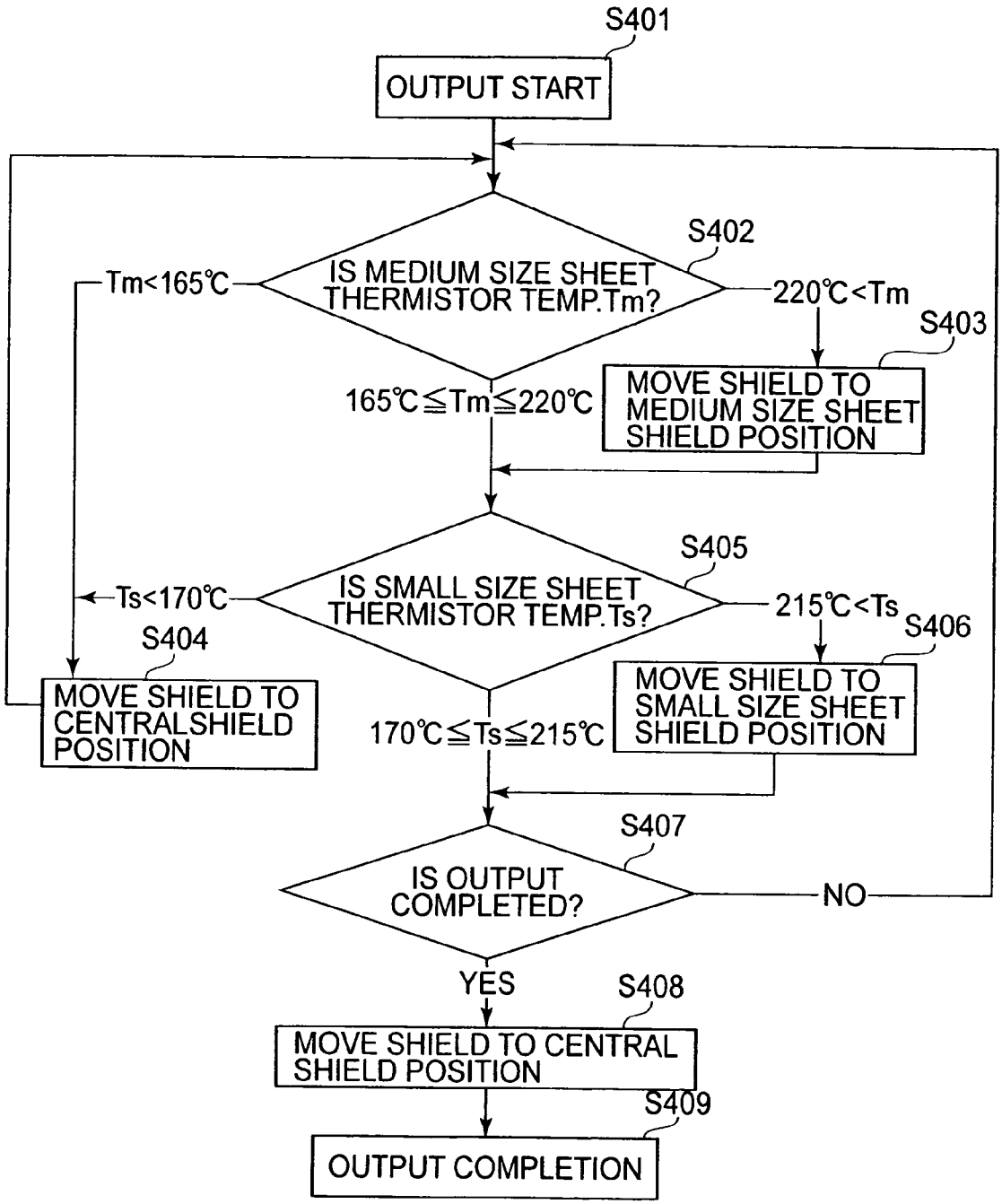
FIG. 15 is an operation sequence diagram of the magnetic flux shielding plate used in Embodiment 4.

Next, an operation sequence of the magnetic flux shielding plate 408 in this embodiment will be described with reference to FIG. 15.

When a fixing operation start instruction is provided from an unshown CPU to the heat fixation apparatus of this embodiment (S401), a temperature Tm of the thermistor for the medium-sized sheet is detected (S402). In the case where the temperature Tm of the medium-sized sheet thermistor is in a predetermined temperature range (165° C.≦Tm≦220° C. in this embodiment), an operation of the magnetic flux shielding plate 408 is not performed. In the case where the temperature Tm exceeds the predetermined temperature range (Tm>220° C. in this embodiment), the magnetic flux shielding plate 408 is moved to the medium-sized sheet shielding position as shown in FIG. 14(*b*) (S403). In the case where the temperature Tm is lower than the predetermined temperature range (Tm<165° C. in this embodiment), the magnetic flux shielding plate 408 is moved to the central shielding position as shown in FIG. 14(*a*) (S404), and then the temperature Tm of the medium-sized sheet thermistor is detected again.

Next, a temperature Ts of the thermistor for the medium-sized sheet is detected (S405). In the case where the temperature Ts of the medium-sized sheet thermistor is in a predetermined temperature range (170° C.≦Ts≦215° C. in this embodiment), an operation of the magnetic flux shielding plate 408 is not performed, and the temperature Tm of the medium-sized sheet thermistor is detected again. In the case where the temperature Ts exceeds the predetermined temperature range (Tm>215° C. in this embodiment), the magnetic flux shielding plate 408 is moved to the small-sized sheet shielding position as shown in FIG. 14(*c*) (S406). In the case where the temperature Ts is lower than the predetermined temperature range (Ts<170° C. in this embodiment), the magnetic flux shielding plate 408 is moved to the central shielding position as shown in FIG. 14(*a*) (S404), and then the temperature Tm of the medium-sized sheet thermistor is detected again.

The above described sequence is repetitively performed until an output completion instruction is provided from the unshown CPU to the heat fixation apparatus of this embodiment.

When the output completion instruction is provided from the unshown CPU, the magnetic flux shielding plate 408 is moved to the central shielding position as shown in FIG. 14(*a*) (S408) to complete the heat fixation operation (S409).

According to the heat fixation apparatus of this embodiment, only a portion of the magnetic flux shielding plate 408 corresponding to a detected temperature is operated while detecting the temperature of the fixation roller 404 in the non-sheet passing portion (area) and the neighbourhood thereof, so that it becomes possible to substantially uniformize a temperature distribution of the fixation roller in the fixation roller longitudinal direction while decreasing the number of operation of the magnetic flux shielding plate 408 even in the case of continuous fixation of recording material including various-sized sheets in mixture.

Incidentally, the constitution of this embodiment is not described so as to limit the scope of the present invention but may be variously modified similarly as in Embodiment 1. For example, the constitution of the magnetic flux shielding plate, the operation sequence, the temperature detection means, and so on may be appropriately changed depending on the heat fixation apparatus used in the present invention. Further, it is also possible to use the constitution of this embodiment in combination with, e.g., the above described constitution of Embodiments 2 and 3.

While the invention has been described with reference to the structures disclosed herein, it is not confined to the details set forth and this application is intended to cover such modifications or changes as may come within the purpose of the improvements or the scope of the following claims.

This application claims priority from Japanese Patent Application No. 307973/2004 filed Oct. 22, 2004, which is hereby incorporated by reference.

What is claimed is:

1. An image heating apparatus comprising:

a coil for generating magnetic flux;

a rotatable heat generation member having a heat generation portion, which generates heat by magnetic flux, for heating an image on a recording material;

a first temperature detection member for detecting a temperature of said heat generation member;

energization control means for controlling energization to said coil on the basis of an output of said first temperature detection member;

magnetic flux reducing means comprising a first magnetic flux reducing portion for principally reducing magnetic flux from said coil toward said heat generation member at a central portion of said heat generation member including a portion at which the temperature is detected by said first temperature detection member in a rotational axis direction of said heat generation member, and a second magnetic flux reducing portion for principally reducing magnetic flux from said coil toward said heat generation member at an end portion of said heat generation member in the rotational axis direction; and moving means for moving said magnetic flux reducing means.

2. An apparatus according to claim 1, wherein said moving means moves said magnetic flux reducing means to a position, at which said first magnetic flux reducing portion acts, when a recording material having a maximum width in the rotational axis direction is passed through said image heating apparatus, and moves said magnetic flux reducing means to a position, at which said second magnetic flux reducing portion acts, when a recording material having a width smaller than a predetermined width in the rotational axis direction is passed through said image heating apparatus.

3. An apparatus according to claim 1, wherein said magnetic flux reducing means comprises a nonmagnetic member.

4. An apparatus according to claim 3, wherein said first magnetic flux reducing portion has a length, in the rotational axis direction, which is smaller than a length corresponding to a maximum width of a recording material, in the rotational axis direction, to be passed through said image heating apparatus.

5. An apparatus according to claim 3, wherein said first magnetic flux reducing portion and said second magnetic flux reducing portion are integrally moved.

6. An apparatus according to claim 5, wherein said magnetic flux reducing means is a single metal plate, and wherein in a moving direction of said metal plate, said first magnetic flux reducing portion is projected at a central portion compared with an end portion and said second magnetic flux reducing portion has a projection portion at which an end portion is projected compared with a central portion.

7. An apparatus according to claim 6, wherein said image heating apparatus further comprises a coil unit, comprising said coil and a magnetic core, disposed in said heat generation member with a spacing, and wherein said metal plate is moved between said coil unit and said heat generation member.

8. An apparatus according to claim 1, wherein said image heating apparatus further comprises a second temperature detection member for detecting a temperature of an area in which a recording material having a minimum size is not passed through said image heating apparatus, and wherein said magnetic flux reducing means is moved on the basis of a difference in detected temperature between said first temperature detection member and said second temperature detection member.

9. An apparatus according to claim 1, wherein said image heating apparatus further comprises a coil unit, comprising said coil and wherein said metal plate is moved between said coil unit and said heat generation member.

* * * * *

UNITED STATES PATENT AND TRADEMARK OFFICE

CERTIFICATE OF CORRECTION

PATENT NO. : 7,268,326 B2
APPLICATION NO. : 11/254835
DATED : September 11, 2007
INVENTOR(S) : Naoyuki Yamamoto et al.

It is certified that error appears in the above-identified patent and that said Letters Patent is hereby corrected as shown below:

ON THE TITLE PAGE
At Item (57), Abstract, Line 2, “uniformize” should read --uniformizing--.

COLUMN 1
Line 65, “noticeably” should read --noticeable--.

COLUMN 2
Line 1, “law” should be read --low--.

COLUMN 3
Line 14, “above described” should read --above-described--.

COLUMN 6
Line 31, “isolate” should read --isolates--.

COLUMN 7
Line 32, “above described” should read --above-described--; and
Line 33, “has” should read --have--.

COLUMN 9
Line 50, “a” should read --an--.

COLUMN 10
Line 16, “above described” should read --above-described--;
Line 21, “operation” should read --operations--; and
Line 26, “operation” should read --operations--.

COLUMN 11
Line 57, “above described” should read --above-described--.

UNITED STATES PATENT AND TRADEMARK OFFICE

CERTIFICATE OF CORRECTION

PATENT NO. : 7,268,326 B2
APPLICATION NO. : 11/254835
DATED : September 11, 2007
INVENTOR(S) : Naoyuki Yamamoto et al.

It is certified that error appears in the above-identified patent and that said Letters Patent is hereby corrected as shown below:

COLUMN 12
Line 6, “operation” should read --operations--;
Line 17, “above described” should read --above-described--; and
Line 18, “constitution” should read --constitutions--.

Signed and Sealed this

Seventeenth Day of February, 2009

JOHN DOLL
*Acting Director of the United States Patent and Trademark Office*